US005782415A

United States Patent [19]

Kepiro

[11] Patent Number: 5,782,415

[45] Date of Patent: Jul. 21, 1998

[54] FLOOR WASHER

[76] Inventor: Joseph Kepiro, 810 Waterfront Dr., Lancaster, Pa. 17602

[21] Appl. No.: 513,403

[22] Filed: Aug. 10, 1995

[51] Int. Cl.[6] ..... B05B 1/28; B05B 3/00; B05B 3/18; A47L 7/00

[52] U.S. Cl. ..... 239/754; 239/288; 15/321

[58] Field of Search ..... 239/273, 288, 239/754; 15/320, 321

[56] References Cited

U.S. PATENT DOCUMENTS 3,663,984 5/1972 Anthony et al. ..... 15/321
3,871,051 3/1975 Collier ..... 15/321
4,956,891 9/1990 Wulff ..... 15/320

FOREIGN PATENT DOCUMENTS 712737 11/1963 Canada ..... 15/321

*Primary Examiner*—Andres Kashnikow
*Assistant Examiner*—Robin O. Evans

[57] ABSTRACT

A floor washer with a housing having a plurality of spray nozzles therein rotatable to different angular relationships to a floor. A nozzle angular relationship to the floor is set prior to use of the washer and held in a fixed position during use of the washer.

6 Claims, 2 Drawing Sheets

FLOOR WASHER

BACKGROUND OF THE INVENTION

1. Field of the Invention

The invention is directed to an improved machine for washing floors.

2. Description of the Prior Art

Normally, the prior art floor washers are in the form of a lawnmower structure wherein the mower blade is replaced with a rotating arm with water nozzles. Typical structures are shown in U.S. Pat. Nos. 5,078,161; 4,000,538 and 5,312,044. An alternate structure is shown in U.S. Pat. No. 3,931,931 wherein a straight tube with nozzles is pushed like a broom.

SUMMARY OF THE INVENTION

A floor washer is provided with a rectangular enclosed area and an open bottom facing the floor. One or more liquid distributor tubes are mounted partly within the rectangular enclosed area. Nozzles are placed along the distributor tube facing the open bottom. The distributor tube can be rotated to point the nozzles at different angles to the floor. Rollers support the floor washer for movement and the rollers are grooved to let liquid escape from the enclosed area. Liquid is supplied to the distributor tube for washing and a cleaning material may be placed within the enclosed area.

DESCRIPTION OF THE PREFERRED EMBODIMENTS

Figure 1:
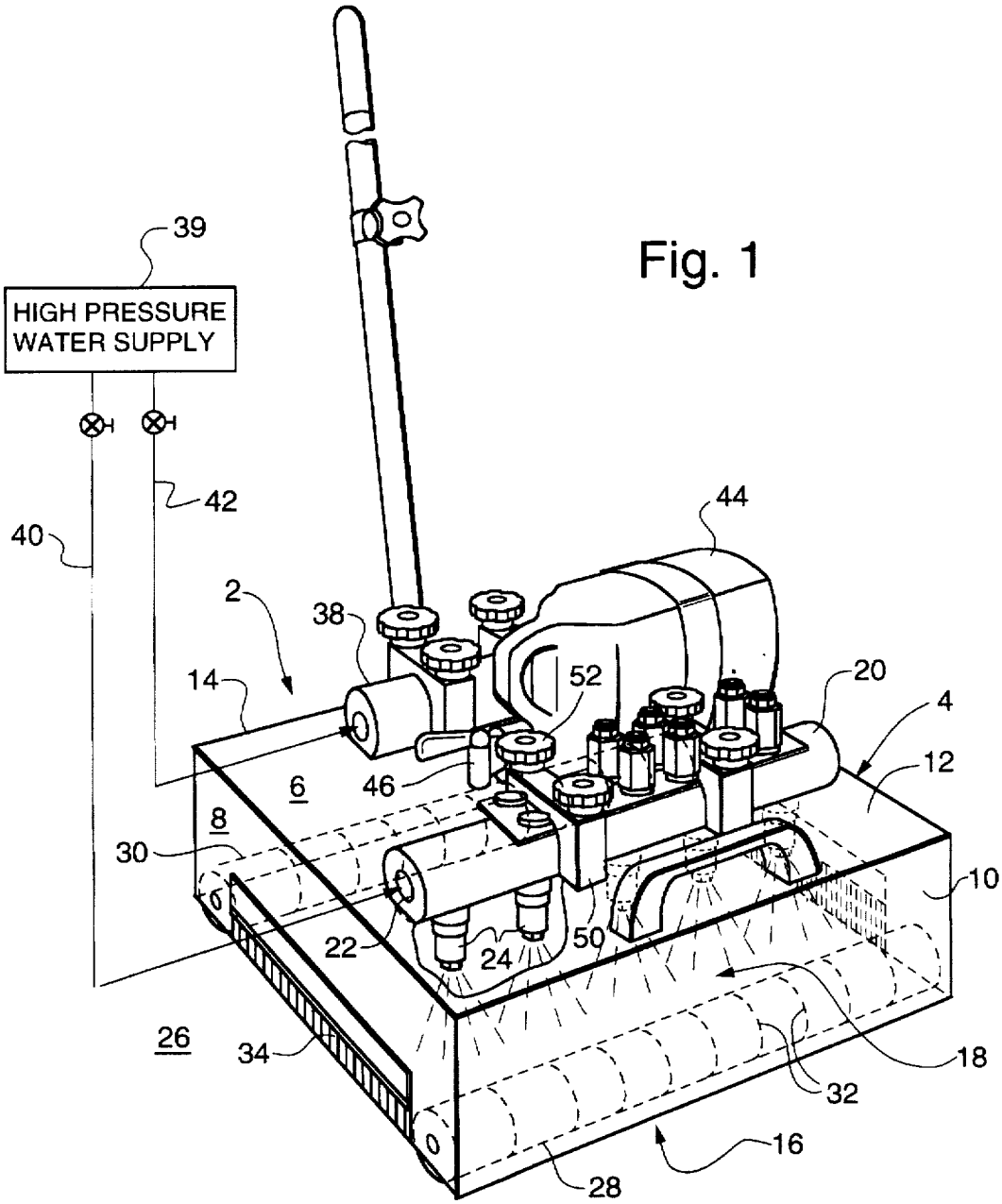
FIG. 1 is a perspective top view of the washer.
Figure 2:
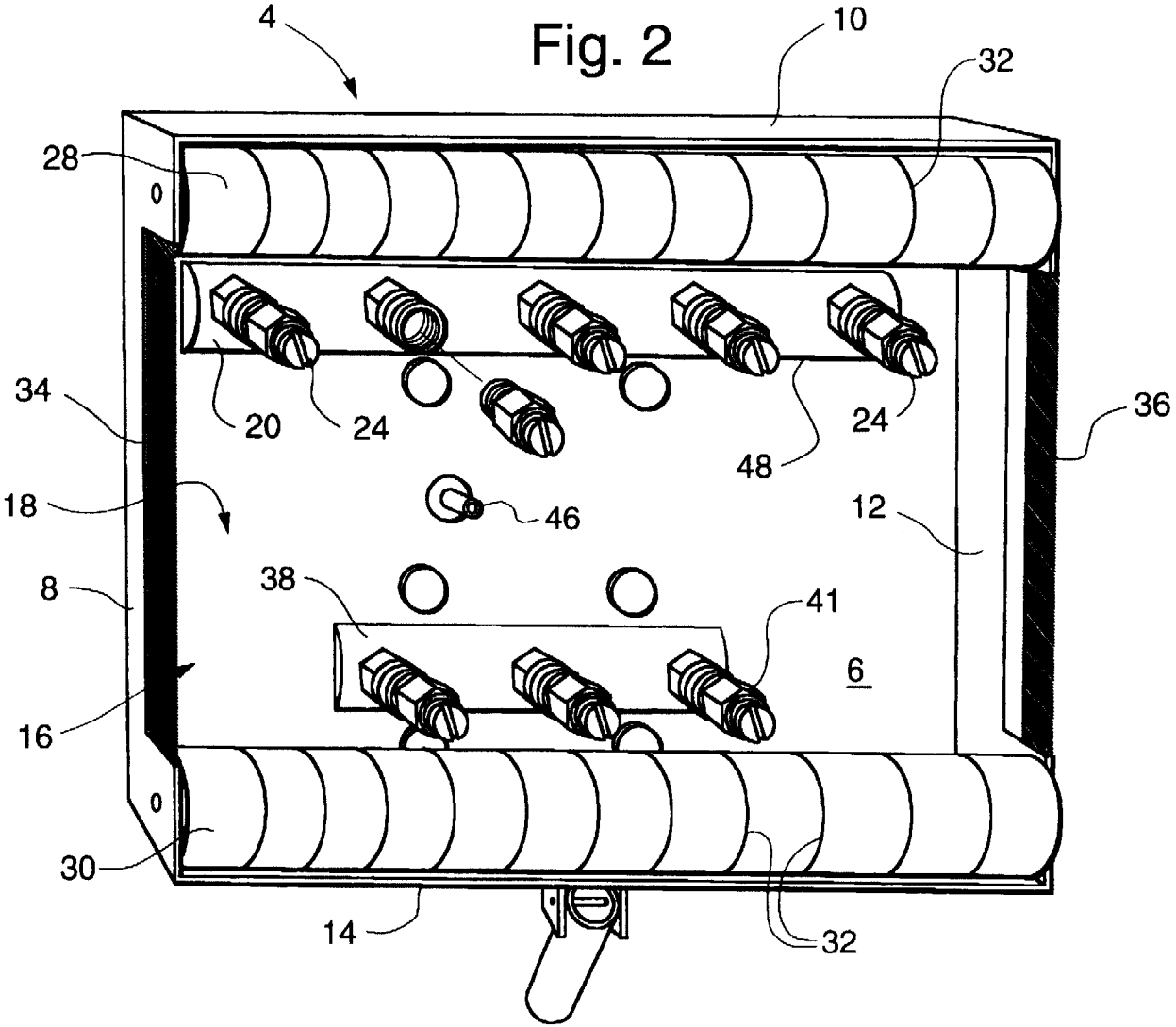
FIG. 2 is a bottom view of the washer.

The floor washer 2 has a housing 4 with a top 6 and four sides 8, 10, 12 and 14. There is an open bottom 16 with a cavity 18. The open bottom 16 faces the floor to be washed. Mounted on the top 6, on the side opposite the cavity 18, is positioned a distributor tube 20 with a bore 22 axially along the interior of the tube. Spray nozzles 24 are affixed to the tube 20 whereby liquid can pass from the bore 22 to the nozzles 24 and then be directed through the cavity 18 to the floor 26 to be washed. The distributor tube 20 and nozzles 24 can be rotated through an arc that permits the nozzles 24 to be directed to the front of the washer, straight down perpendicular to the floor or to the rear of the washer or any position therebetween.

A roller 28 is mounted on the front wall 10 and a roller 30 is mounted on the rear wall 14 to form a means to permit the housing 4 to roll across the floor. The rollers 28 and 30 prevent the liquid sprayed onto the floor from quickly spurting out the front and back of the housing 4. However, the rollers 28 and 30 are provided with narrow grooves 32 that permit slow water leakage from the housing 4 to prevent a build-up of water in the housing and therefor dilute the force of the spray action of the nozzles 24. Conventional narrow brush-like elements 34 and 36 are positioned on the sides 8 and 12 to permit slow leakage of water from the cavity 18 out the sides of the housing 4. An high pressure water supply means 38, by an hose or piping 40, supply liquid to the bore 22 of the distributor tube 20.

A second distributor tube 38 is provided with nozzles 40. This tube 38 is constructed the same and operates the same as the distributor tube 20. The same water supply means 38 supplies liquid to the second distributor tube 38, but by using a separate hose or piping 42. Mounted between the two distributor tubes 20 and 38 is a container 44 that may hold a cleaning liquid, such as soap or a chemical cleaner. A hose and valve assembly 46 controls the flow of cleaning liquid to the cavity 18.

As indicated above the distributor tubes may be rotated to change the angle at which the nozzles 24 and 40 direct the liquid to the floor. A distributor tube is positioned in a rectangular slot 48 in the top 6 of the housing 4. The slot 48 is shaped with a width less than the diameter of the tube so the tube is supported by the housing top 6, but the portion of the tube having the nozzles extends into the cavity 18. The tube is held in place on the housing top 6 by brackets 50 and mounting bolts 52 on the outside of the housing top. Tightening the bolts 52 forces the brackets 50 against the top of a distributor tube to frictionally hold the tube in position between the slot 48 at the top 6 of the housing 4 and the bracket(s) 50. When the bolts 52 are loosened, the tube can be rotated to direct the nozzles 24 or 40 at a different angle.

What is claimed is:

1. A floor washer comprising:

a.) a housing with a cavity formed by four sides, being a front side, a back side, a left side and a right side, a top and an open bottom, b.) at least one distributor tube with a central passageway mounted on the top of the housing substantially outside the cavity, said tube having affixed thereto spray nozzles, said distributor tube and said nozzles extending into said cavity directed toward the open bottom, c.) said distributor tube and nozzles being rotated along the axis of the tube, but fixed in position during use, to let the fixedly positioned nozzles spray at a angle to the floor upon which the floor washer moves, d.) means mounted on the open bottom of the housing to permit the housing to roll across the floor, and e.) means supplying liquid to the distributor tube.

2. A floor washer comprising:

a.) a housing with a cavity formed by four sides, being a front side, a back side, a right side, a left side, a top and an open bottom, b.) at least one distributor tube with an axis and with a central passageway mounted on the top of the housing substantially outside the cavity, said tube having affixed thereto spray nozzles, said distributor tube extending partly into said cavity and said nozzles extending completely into said cavity and being generally directed toward the open bottom, c.) said distributor tube and nozzles being rotated along the axis of the tube, but fixed in position during use, to let the fixedly positioned nozzles spray at different angles to the open bottom and the floor upon which the floor washer moves, d.) means mounted on the open bottom of the housing to permit the housing to roll across the floor, said means being a pair of rollers positioned at the front and back sides of the housing, said rollers being provided with narrow groove means to permit only slow water leakage from the housing and not permit water to quickly spurt out the front and back of the housing cavity, e.) narrow brush-like elements are positioned on the right and left sides of the housing to permit only slow leakage of water from the housing cavity, whereby the rollers and brush-like elements are a means preventing the spurting of water from the housing cavity, but still permit controlled leakage of water to prevent a build-up of water in the housing to dilute the cleaning force of the spray nozzles, and f.) means supplying water or like liquid material to the distributor tube portion outside the cavity.

3. The floor washer of claim 2 wherein a second distribution tube with a central passageway mounted on the top of the housing substantially outside the cavity, said tube having affixed thereto spray nozzles, said nozzles extending into said cavity directed toward the open bottom.

4. The floor washer of claim 3 wherein mounting means permit rotation of the distribution tubes, but hold the tubes in a fixed position during a floor washing operation.

5. The floor washer of claim 4 wherein a means supplies a cleaning liquid to the cavity to interact with the liquid supplied to the cavity.

6. The floor washer of claim 5 wherein the liquid supply means provides a separate controllable supply of liquid to the distribution tubes.

* * * * *